US010753629B2

(12) United States Patent
Wakabayashi et al.

(10) Patent No.: US 10,753,629 B2
(45) Date of Patent: Aug. 25, 2020

(54) VENTILATION DEVICE FOR INFANT INCUBATOR AND INFANT INCUBATOR

(71) Applicant: ATOM MEDICAL CORPORATION, Tokyo (JP)

(72) Inventors: Keisuke Wakabayashi, Saitama (JP); Hidetoshi Sato, Saitama (JP); Kazunori Miyagawa, Saitama (JP); Yoshiyuki Komiyama, Saitama (JP); Ichiro Matsubara, Tokyo (JP)

(73) Assignee: ATOM MEDICAL CORPORATION, Tokyo (JP)

( * ) Notice: Subject to any disclaimer, the term of this patent is extended or adjusted under 35 U.S.C. 154(b) by 198 days.

(21) Appl. No.: 15/975,118

(22) Filed: May 9, 2018

(65) Prior Publication Data

US 2018/0328609 A1 Nov. 15, 2018

(30) Foreign Application Priority Data

May 10, 2017 (JP) ..... 2017-093561

(51) Int. Cl.
*F24F 7/10* (2006.01)
*F04D 25/08* (2006.01)
(Continued)

(52) U.S. Cl.
CPC ..... *F24F 7/10* (2013.01); *F04D 25/08* (2013.01); *F04D 25/166* (2013.01);
(Continued)

(58) Field of Classification Search
CPC ..... F24F 7/10; F24F 11/0001; F04D 25/08; F04D 25/166; A61G 11/003; A61G 11/009
(Continued)

(56) References Cited

U.S. PATENT DOCUMENTS 4,509,505 A * 4/1985 Mercey ..... A61G 11/00 600/22
2013/0345494 A1 12/2013 Matsubara et al.
2019/0049121 A1* 2/2019 Jones ..... F24D 19/10

FOREIGN PATENT DOCUMENTS

EP 0813032 12/1997
JP H09-159242 6/1997
JP 2014-004157 1/2014

* cited by examiner

*Primary Examiner* — Steven B McAllister
*Assistant Examiner* — Allen R Schult
(74) *Attorney, Agent, or Firm* — Brinks Gilson & Lione

(57) ABSTRACT

A ventilation device installed on an infant incubator having a chamber of an infant, including: an exhaust part including an exhaust connect port connected to the chamber and an exhaust port communicated with the exhaust connect port; an air-supply part including an air-supply connect port connected to the chamber and an intake port of external air communicated with the air-supply connect port; at least one of an exhaust blower and an air-supply blower: the exhaust blower is provided at the exhaust part and generates an air stream flowing from the exhaust connect port toward the exhaust port, and the air-supply blower is provided at the air-supply part and generates an external-air stream flowing from the intake port of the external air toward the air-supply connect port: the air is exhausted from the chamber through the exhaust part, and the external air is supplied into the chamber through the air-supply part.

4 Claims, 15 Drawing Sheets

(51) Int. Cl.
*F04D 25/16* (2006.01)
*F24F 11/00* (2018.01)
*A61G 11/00* (2006.01)

(52) U.S. Cl.
CPC ..... *A61G 11/003* (2013.01); *A61G 11/009* (2013.01); *F24F 11/0001* (2013.01)

(58) Field of Classification Search
USPC ..... 454/237
See application file for complete search history.

VENTILATION DEVICE FOR INFANT INCUBATOR AND INFANT INCUBATOR

RELATED APPLICATIONS

Priority is claimed on Japanese Patent Application No. 2017-93561, filed May 10, 2017, the content of which is incorporated herein by reference.

BACKGROUND OF THE INVENTION

Technical Field

The present invention relates to a ventilation device for an infant incubator which is installed on an infant incubator in which an infant can be nursed in a chamber for an infant to control environment in the chamber; and relates to an infant incubator provided with the ventilation device.

Background Art

Conventionally, in an enclosed-type infant incubator, a chamber for infant in which an infant is nursed is supplied with conditioned air in temperature and humidity so that environment in the chamber is maintained suitably.

For example, Patent Document 1 discloses an infant incubator provided with an air-conditioning system circulating controlled air in temperature and humidity in a chamber for infant using a conditioning tub communicated with the chamber.

The air-conditioning system is provided with a fan moving air in the conditioning tub, a heater heating the air in the conditioning tub, and a humidifier supplying water vapor into the air in the conditioning tub, so that the air in the chamber and external air are taken into the conditioning tub. The air heated and humidified in the conditioning tub is supplied into the chamber from the conditioning tub, so that the air in which temperature and humidity are conditioned is supplied to and circulated in the chamber.

CITATION LIST

Patent Document 1: Japanese Unexamined Patent Application, First publication No. 2014-4157

SUMMARY OF INVENTION

Technical Problem

As explained above, in the infant incubator provided with the air-conditioning system, the air in the chamber is maintained to have a prescribed temperature and humidity by taking in the external air, and heating and humidifying the external air.

However, if a respiratory supporting device of a CPAP (Continuous Positive Airway Pressure) method, a high flow therapy or the like which helps spontaneous respiration is used for nursing and treating an infant in the chamber, the chamber is supplied with heated and humidified air in the other part than the air-conditioning system, so there is a risk that the temperature and the humidity in the chamber be raised over a prescribed limit.

There is a case in which a cover is put over the chamber, for reasons of prompting a circadian rhythm by making a cycle of light and darkness of day and night, and prompting an improvement of a sleep state by cutting light and sound off, and the like. However, heat radiation property is obstructed by the cover so that heat retaining property is increased, there is a risk that the temperature in the chamber be raised.

In such a case, it is examined to reduce increment of the temperature and the humidity in the chamber by stopping the heater and humidifier of the air-conditioning system: however, increasing of the temperature and the humidity by the heated heater or the like is not quickly stopped.

Even though the heater and the humidifier of the air-conditioning system is stopped and left the state, it takes a long time to reduce the temperature and the humidity in the chamber to the temperature and the humidity as the outside. Therefore, it is not possible to prevent the temperature and the humidity in the chamber from increasing, so there is a risk that body temperature of the infant is unstable.

Reducing the temperature and the humidity in the chamber forcibly to the temperature and the humidity of the outside is also requested.

The present invention is achieved in consideration of the above circumstances, and has an object to provide a ventilation device for an infant incubator and an infant incubator provided with a ventilation device, which can forcibly reduce temperature and humidity in a chamber for infant, and smoothly control environment in the chamber.

Solution to Problem

The present invention is a ventilation device installed on an infant incubator provided with a chamber of an infant. The ventilation device of the present invention includes an exhaust part provided with an exhaust connect port connected to the chamber and an exhaust port communicated with the exhaust connect port; an air-supply part provided with an air-supply connect port connected to the chamber and an intake port of external air communicated with the air-supply connect port; at least one of an air-supply blower and an exhaust blower: the air-supply blower is provided at the air-supply part and generates an external-air stream flowing from the intake port of the external air toward the air-supply connect port, and the exhaust blower is provided at the exhaust part and generates an air stream flowing from the exhaust connect port toward the exhaust port. In the ventilation device, the air is exhausted from the chamber through the exhaust part, and the external air is supplied into the chamber through the air-supply part.

An incubator provided with an air-conditioning system maintains the air in a chamber to a prescribed temperature and humidity higher than that of the outside (the external air) by heating and humidifying the air with circulating the air in the chamber; and the incubator is structured to maintain a pressure in the chamber being greater than the outside.

Therefore, even if increasing a rotation number of a fan of the air-conditioning system and an air-flow rate (an is increased, the air is just circulated mostly in the chamber, so that new external air is not easy to be introduced in.

Accordingly, in an infant incubator structured as above, installing the ventilation device of the present invention, the air in the chamber can be actively exhausted or the external air is introduced into the chamber by the blower of the ventilation device, so that the air can be freshened by the external air.

As a result, the temperature and the humidity in the chamber can be forcibly reduced without providing a cooler and a dehumidifier, so that the temperature and the humidity in the chamber (environment) can be smoothly controlled.

It is preferable that the ventilation device of the present invention be further provided with a supply guide duct communicated with the air-supply connect port and disposed in the chamber, and guiding the external-air stream introduced into the chamber toward a prescribed direction.

Providing the supply guide duct, the external air is newly introduced into the chamber and guided along the prescribed direction, so as to flow on a stream of the air circulated in the chamber.

As a result, the new introduced external air can be mixed with the circulated air in the chamber without obstructing the circulating stream. Accordingly, the temperature and the humidity in the chamber can be quickly controlled to be even.

In the ventilation device according to the present invention, it is preferable that both the exhaust blower and the air-supply blower be provided.

Providing a blower at at least either one of the exhaust part and the air-supply part, the air in the chamber can be replaced with the external air. Moreover, providing the blowers both at the exhaust part and the air-supply part, it is possible to precisely control an exhaust air-flow rate from the chamber by the exhaust part and a supplying air-flow rate of the external air by the air-supply part.

Accordingly, it is possible to precisely control the temperature and the humidity in the chamber.

In the ventilation device according to the present invention, it is preferable that the supplying air-flow rate of the air-supply blower be larger than the exhaust air-flow rate of the exhaust blower.

In this case, the pressure in the chamber can be maintained to be greater than the outside, it is possible to prevent the external air from flowing without filtering at the air-supply part and the like into the chamber through the other part than the air-supply part.

An infant incubator according to the present invention includes: a chamber of an infant, provided with through holes which communicate inside and outside the chamber; and a ventilation device detachably installed on the chamber. The ventilation device of the infant incubator according to the present invention is provided with: an exhaust part provided with an exhaust connect port connected to one of the through holes of the chamber and an exhaust port communicated with the exhaust connect port; an air-supply part provided with an air-supply connect port connected to another of the through holes of the chamber and an intake port of external air communicated with the air-supply connect port; at least one of an air-supply blower and an exhaust blower: the air-supply blower is provided at the air-supply part and generates an external-air stream flowing from the intake port of the external air toward the air-supply connect port, and the exhaust blower is provided at the exhaust part and generates an air stream flowing from the exhaust connect port toward the exhaust port. In the infant incubator of the present invention, the air is exhausted from the chamber through the exhaust part, and the external air is supplied into the chamber through the air-supply part.

In this case, the ventilation device is detachably installed on the infant incubator as needed, so that it is possible to exchange the air in the chamber for the external air efficiently.

In the infant incubator of the present invention, it is preferable to further include an air-conditioning system provided with: a conditioning tub communicating with the chamber through communication holes; and a circulator generating an air-stream circulating between the chamber and the conditioning tub; and a supply guide duct communicating with the air-supply connect port of the air-supply part and disposed in the chamber, extending from the through hole to which the air-supply connect port is connected toward one of the communication holes.

According to this structure, it is possible to supply the external air to the chamber and the chamber can be evacuated, without obstructing the air-stream formed by the air-conditioning system.

In the infant incubator of the present invention, it is preferable that both the exhaust blower and the air-supply blower be provided.

In this case, the exhaust air-flow rate and the supplying air-flow rate can be precisely controlled.

In the infant incubator of the present invention, it is preferable that a supplying air-flow rate of the air-supply blower be larger than an exhaust air-flow rate of the exhaust blower. In this case, the pressure in the chamber can be greater than the outside, so that it is possible to prevent the external air from flowing into the chamber through the other part than the filter.

Advantageous Effects of Invention

According to the present invention, the external air can be actively taken into the chamber by evacuating outside the chamber, so that the temperature and the humidity can be reduced in the chamber by exchanging the air in the chamber for the external air, and it is possible to smoothly control environment in the chamber.

DESCRIPTION OF EMBODIMENTS

Figure 6:
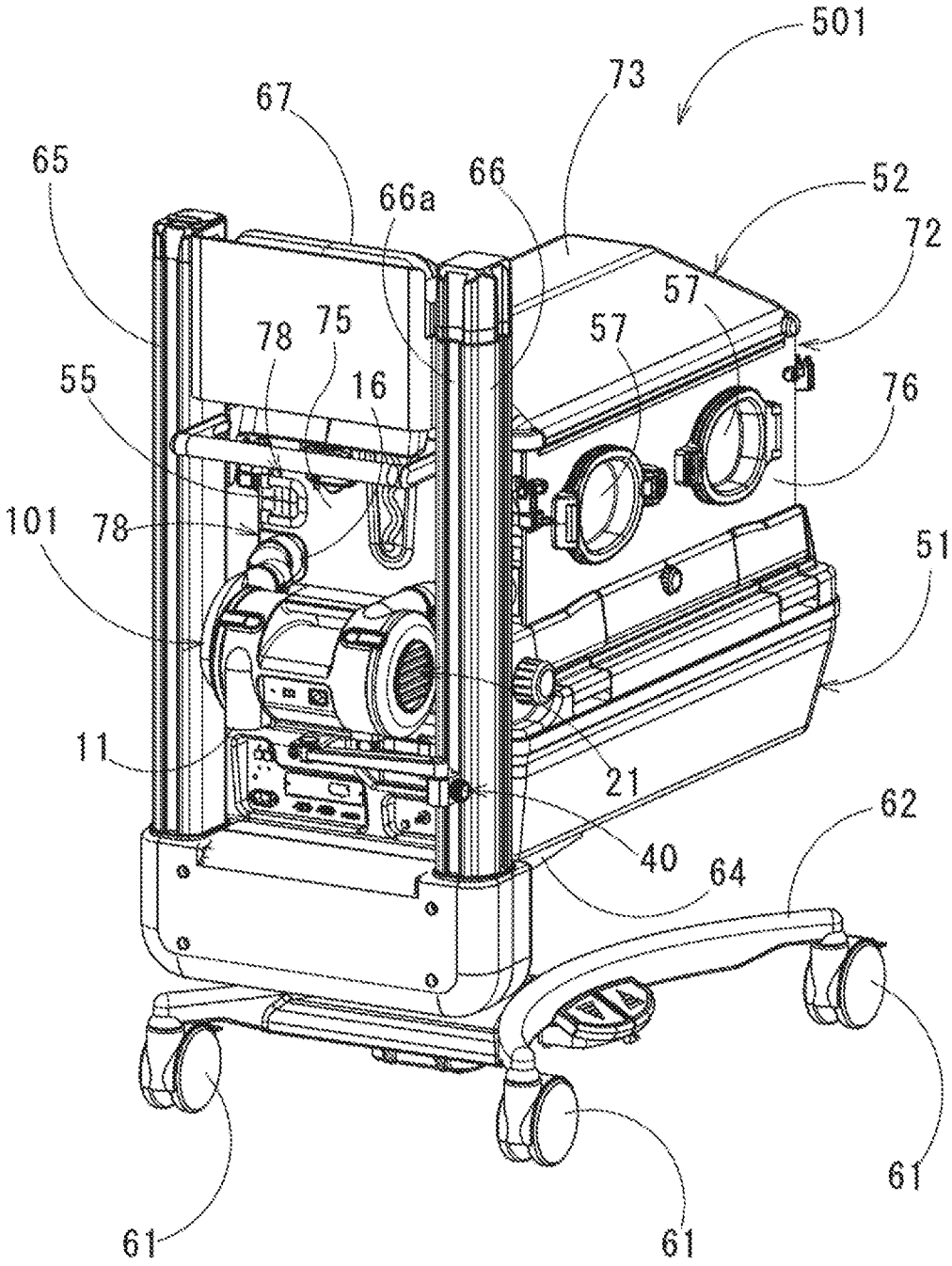
FIG. 6 is an outside perspective view of an infant incubator on which the ventilation device of the embodiment of the present invention is installed, seen from a rear side.

Below, an embodiment of a ventilation device for an infant incubator and an infant incubator provided with the ventilation device will be explained referring drawings. A ventilation device 101 for an infant incubator of the present embodiment is used in a state of being attached on an infant incubator 501 provided with a chamber (an enclosure) 52 in which an infant is nursed inside, as shown in FIG. 6.

Structure of Infant Incubator

The infant incubator 501 on which the ventilation device 101 for the infant incubator is installed will be explained.

As a whole is shown in FIG. 6 to FIG. 9, the infant incubator 501 is provided with a base table 51 and the chamber 52 formed on the base table 51 to have substantially a rectangular box shape. In the infant incubator 501 shown in FIG. 6 to FIG. 9, a trolley 62 which can move by casters 61, a support post 63 vertically stood on the trolley 62 (refer to FIG. 8), and a frame 64 installed on an upper end of the support post 63 are provided; the base table 51 is disposed on the frame 64.

On one end part of the frame 64, two guide posts 65 and 66 stand vertically beside the chamber 52. One guide post 65 between the guide posts 65 and 66 supports a top-hood part 73 of the chamber 52 so as to move up and down; the other guide post 66 supports a heater 67 so as to move up and down.

The chamber 52 is provided with a floor plate 71 on which a bed 53 is disposed for laying an infant down, an enclosure-frame part 72 formed on the floor plate 71 so as to enclose around an infant space 54 above the floor plate 71, and the top-hood part 73 which can selectively cover an upper opening of the enclosure-frame part 72.

The enclosure-frame part 72 is provided with a front-wall part 74 disposed at a feet side of the infant, a rear-wall part 75 disposed at a head side of the infant, and treatment doors 76 and 77 disposed at left and right sides of the infant.

Figure 8:
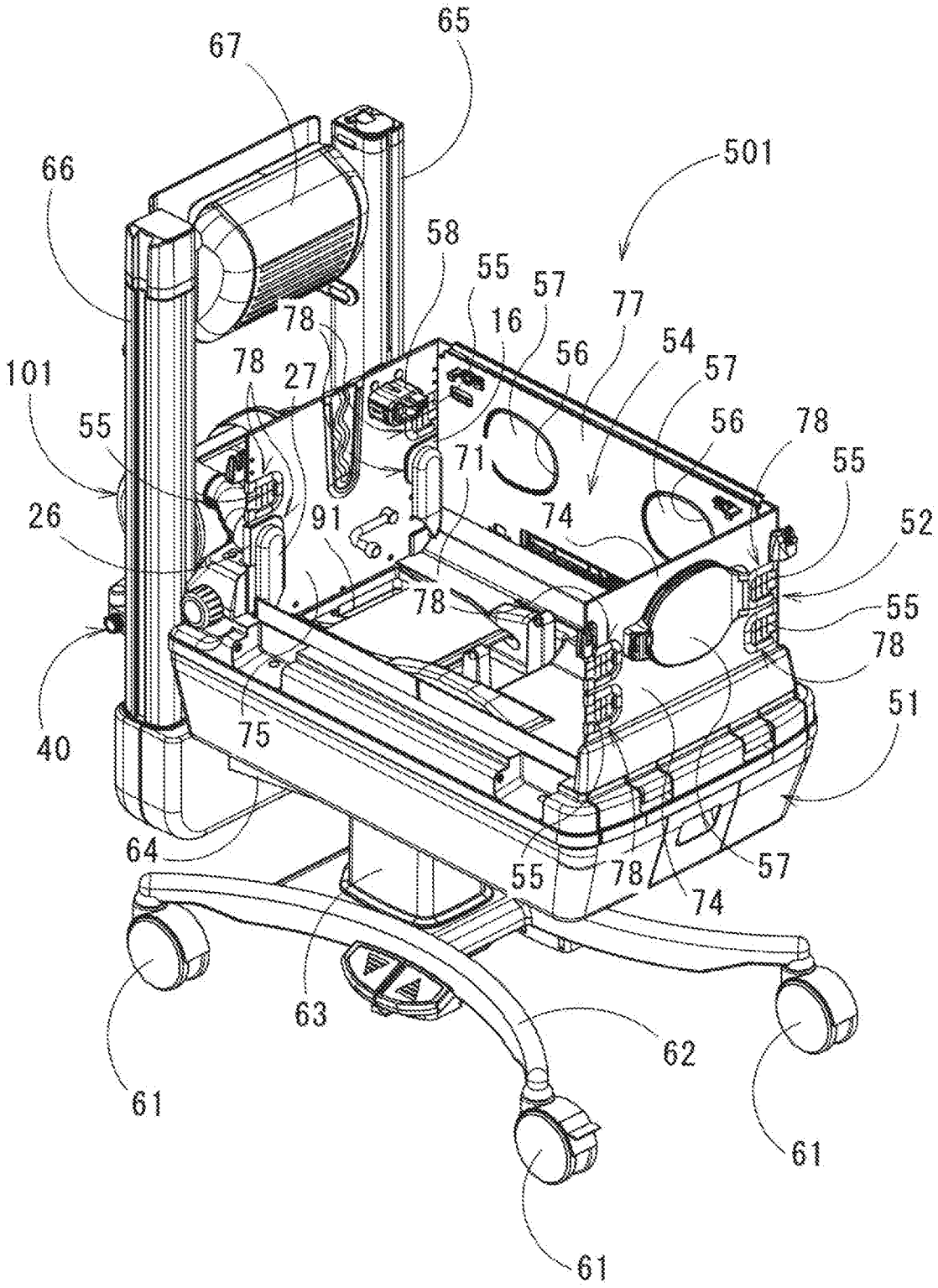
FIG. 8 is a perspective view showing the infant incubator from which a top-hood part, a treatment door at a left side, and a bed are detached.
Figure 9:
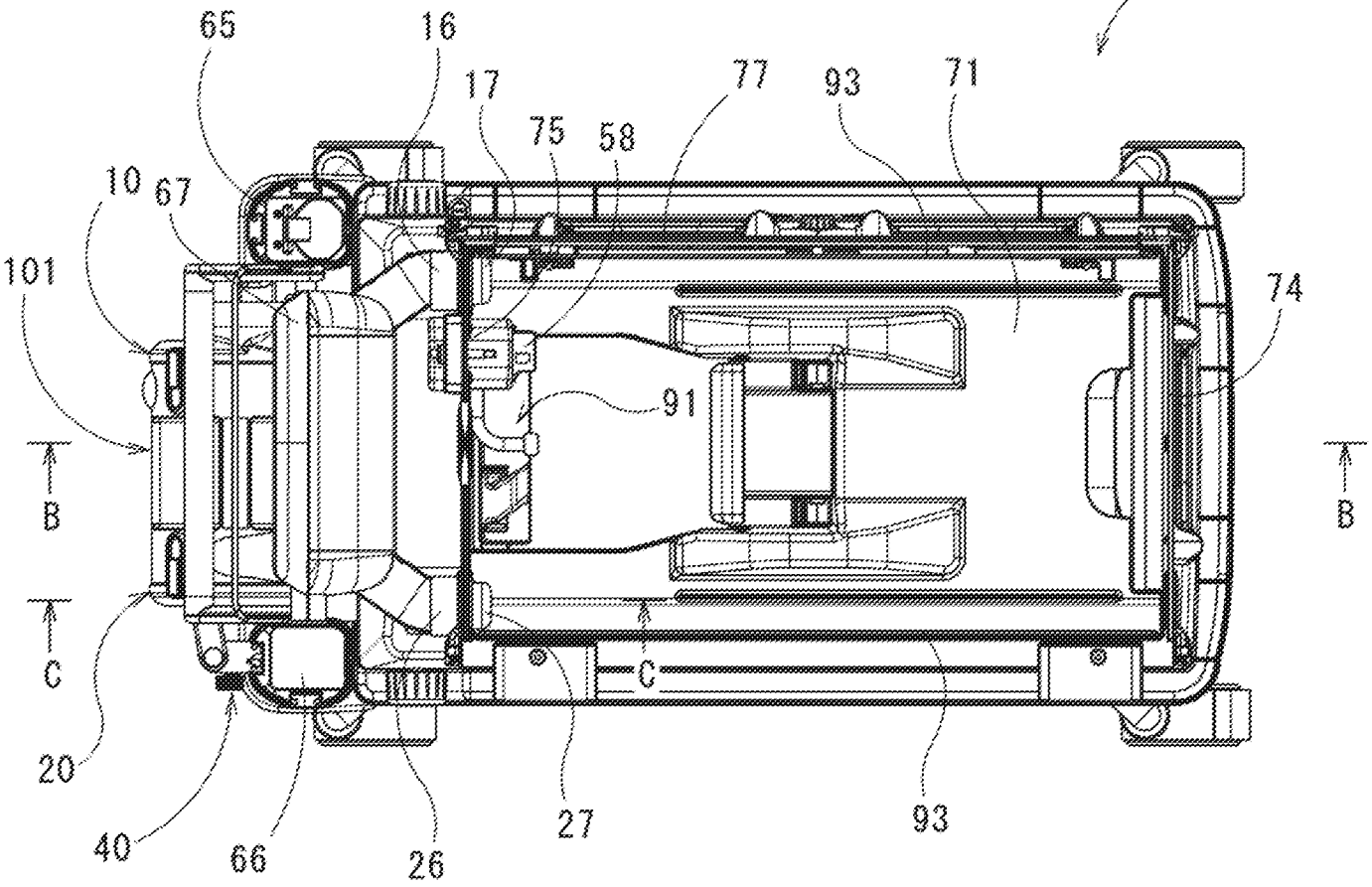
FIG. 9 is a top view of the infant incubator shown in FIG. 8.

Sealing members (not illustrated) are respectively disposed between the floor plate 71, parts 74 to 77 of the enclosure-frame part 72, and the top-hood part 73 forming the chamber 52, so that the infant space 54 in the chamber 52 is cut off from the external air. FIG. 8 and FIG. 9 show a state in which the top-hood part 73, the left treatment door 76, and the bed 53 are detached in order to show the infant space 54 in the chamber 52.

The enclosure-frame part 72 and the top-hood part 73 forming the chamber 52 are formed almost entirely from transparent resin, so that the infant in the chamber 52 can be checked with eyes from the outside.

At the front-wall part 74 and the rear-wall part 75 of the enclosure-frame part 72, through holes 78 are formed respectively for inserting cables, tubes and the like. Rubber made grommet members 55 having slits are fitted to the through holes 78 so as to protect the cables or the tubes and obstruct ventilation through the through holes 78. The through holes 78 are formed at four at the front-wall part 74 as shown in FIG. 8, one on each upper and lower parts in the left side, and one on each upper and lower parts in the right side. The through holes 78 are formed at four at also the rear-wall part 75, one on each upper and lower parts in the left side, and one on each upper and lower parts at the right side.

Figure 7:
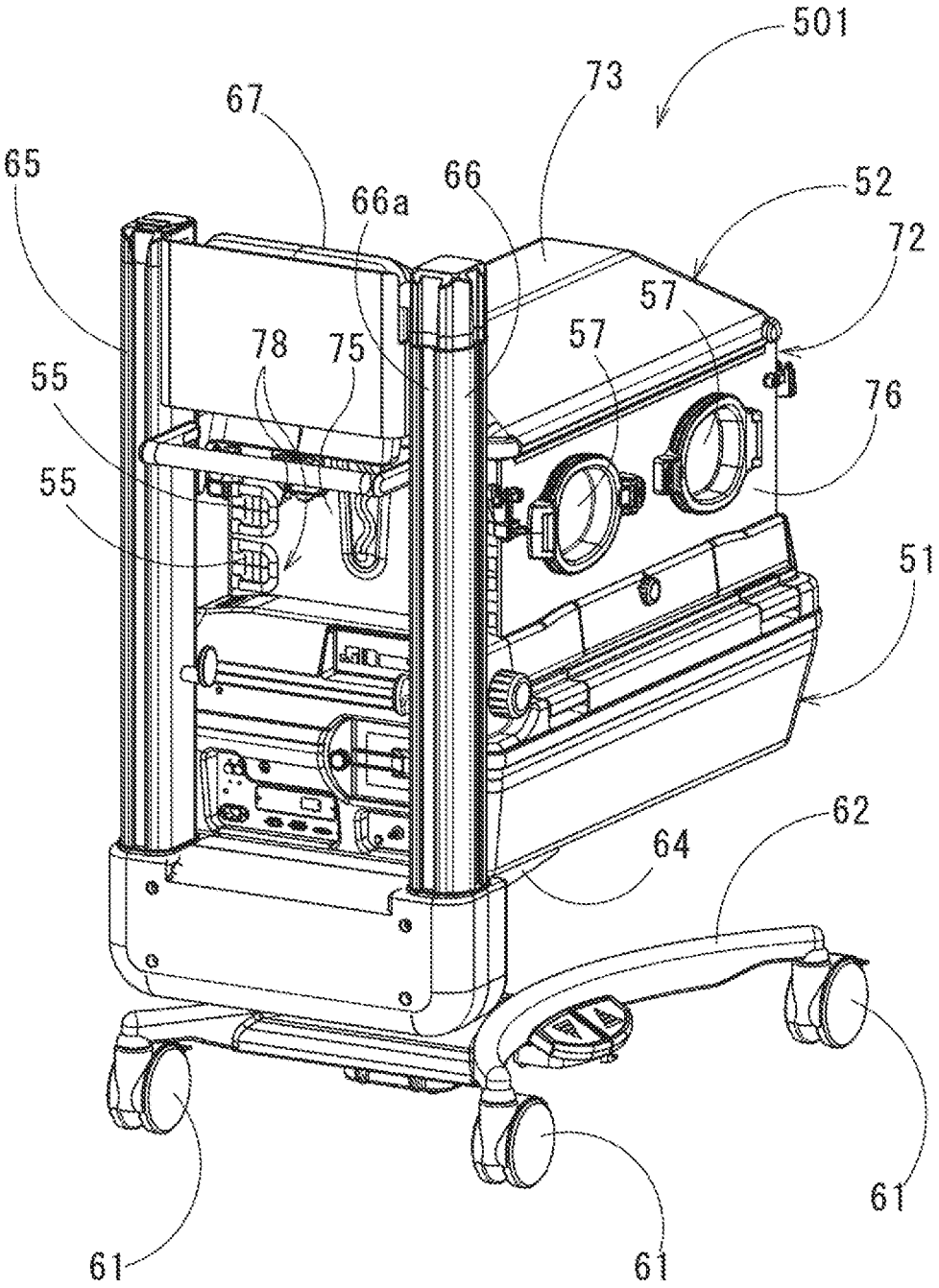
FIG. 7 is a perspective view showing a state in which the ventilation device is detached from the infant incubator shown in FIG. 6.

The infant incubator 501 is an enclosed type. FIG. 6 and FIG. 7 show a state in which the chamber 52 is closed by pulling down the top-hood part 73. In this infant incubator 501, it is possible to open the upper of the chamber 52 by lifting up the top-hood part 73; and further, it is possible to open the front-wall part 74 and the left and right treatment doors 76 and 77 of the enclosure-frame part 72 individually. Opening these parts, it is possible to examine and treat the infant from any direction. When the top-hood part 73 and the like are open, the heater 67 can warm inside the chamber 52.

On the front-wall part 74 and the left and right treatment doors 76 and 77, access ports 56 are respectively disposed for entering hands inside. Doors 57 are disposed respectively for the access ports 56 to be open and shut. Accordingly, an operator can treat the infant in the chamber 52 by entering hands through the access ports 56 into the chamber 52, while the front-wall part 74 and the treatment doors 76 and 77 being kept closed.

In addition, even when the doors 57 are open, it is possible to prevent that the external air flows into the chamber 52 through the access ports 56 by maintaining the pressure in the chamber 52 to be slightly greater than the outside.

Figure 10:
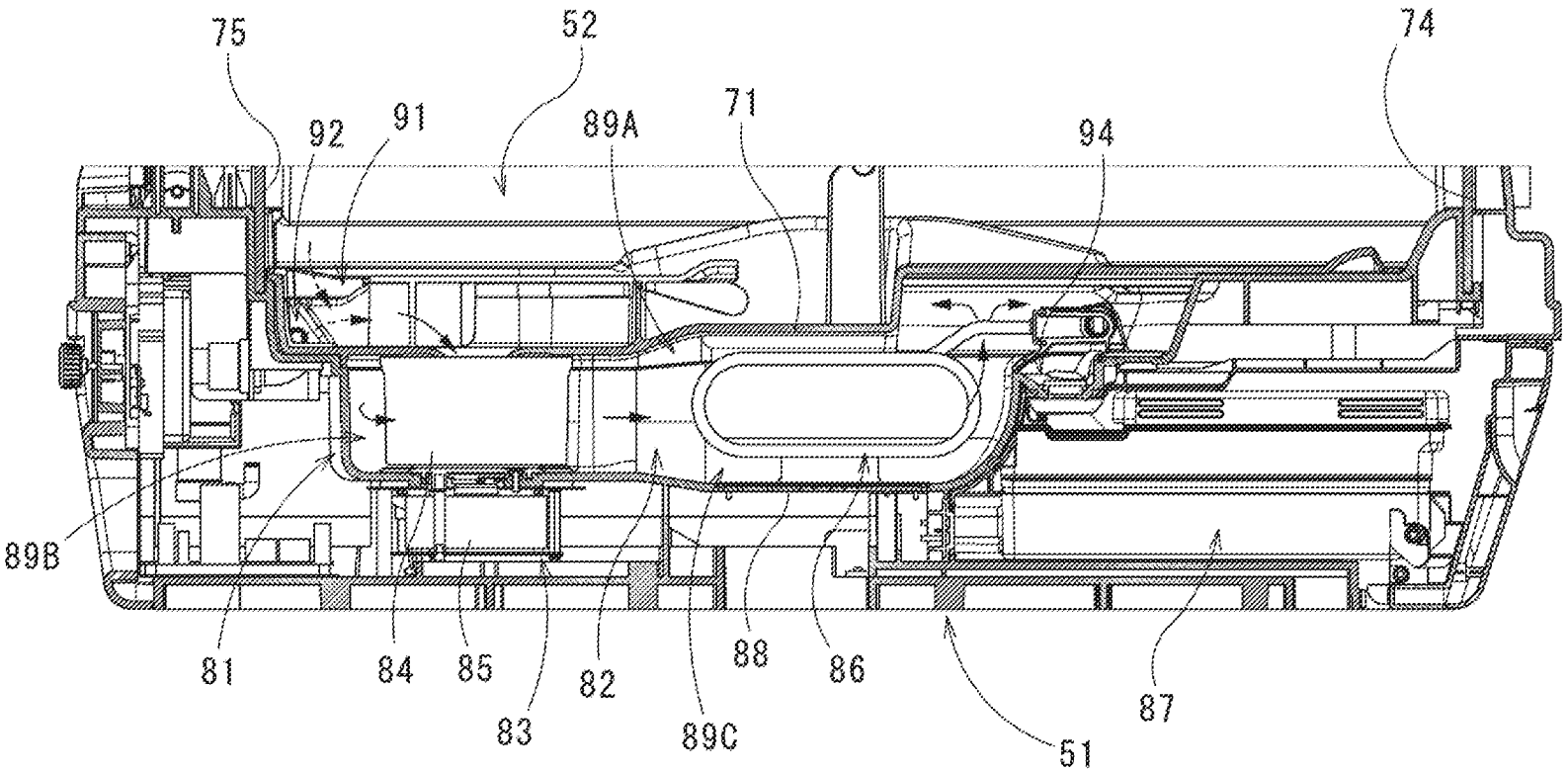
FIG. 10 is a cross-sectional view of a base table of the infant incubator taken along the line B-B shown in FIG. 9.

FIG. 10 shows a cross sectional view around the base table 51 of the infant incubator 501 taken along the line B-B in FIG. 9. As shown in FIG. 10, an air-conditioning system 81 is equipped in the base table 51 below the chamber 52.

The air-conditioning system 81 is provided with a conditioning tub 82 communicated with the chamber 52, a circulator 83 moving the air in the conditioning tub 82 for circulating the air, a heater 86 heating the air in the conditioning tub 82, and a humidifier 87 supplying water vapor to the air in the conditioning tub 82. Conditioned air in temperature and humidity by the heater 86 and the humidifier 87 in the conditioning tub 82 is supplied to the chamber 52 by the circulator 83. The circulator 83 is formed from a centrifugal blower having a fan 84 and a motor 85, for example. Temperature in the chamber 52 is measured by a temperature sensor 58 installed at an upper part of the rear-wall part 75.

Figure 11:
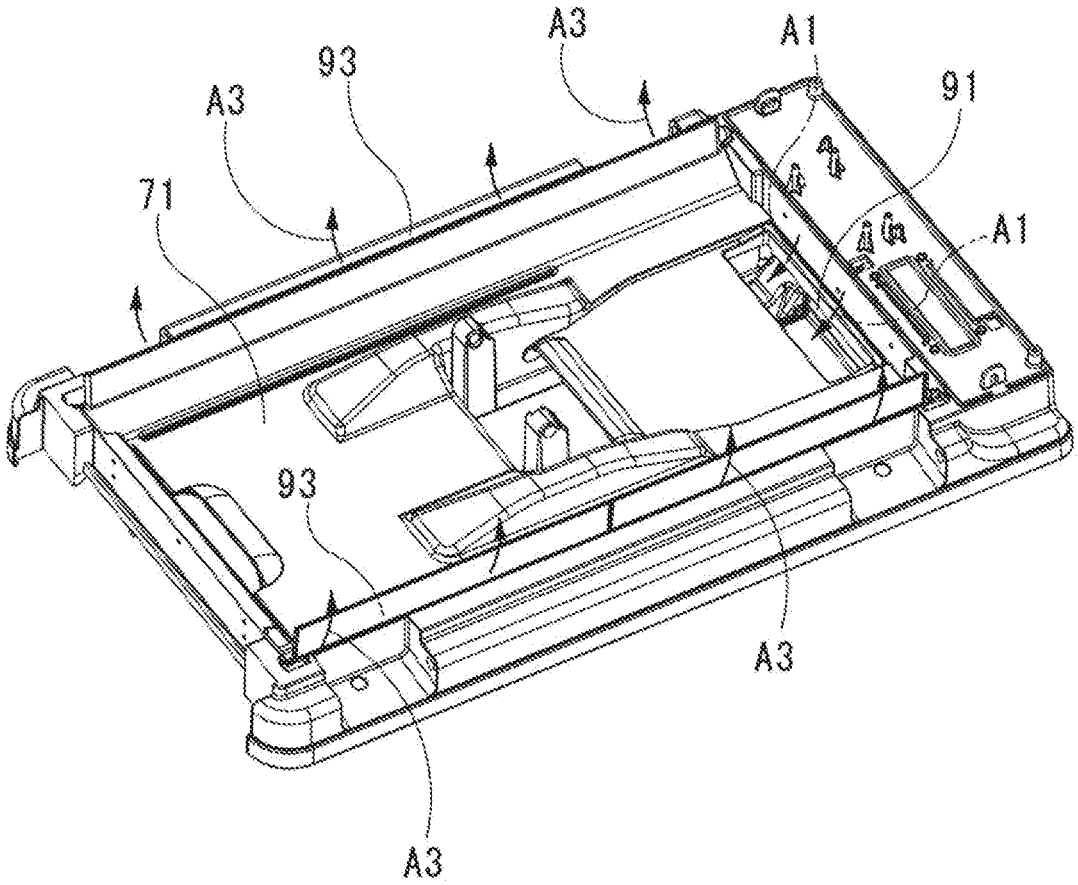
FIG. 11 is a perspective view showing the infant incubator in a state in which the bed in the chamber is detached and a floor plate is exposed.
Figure 12:
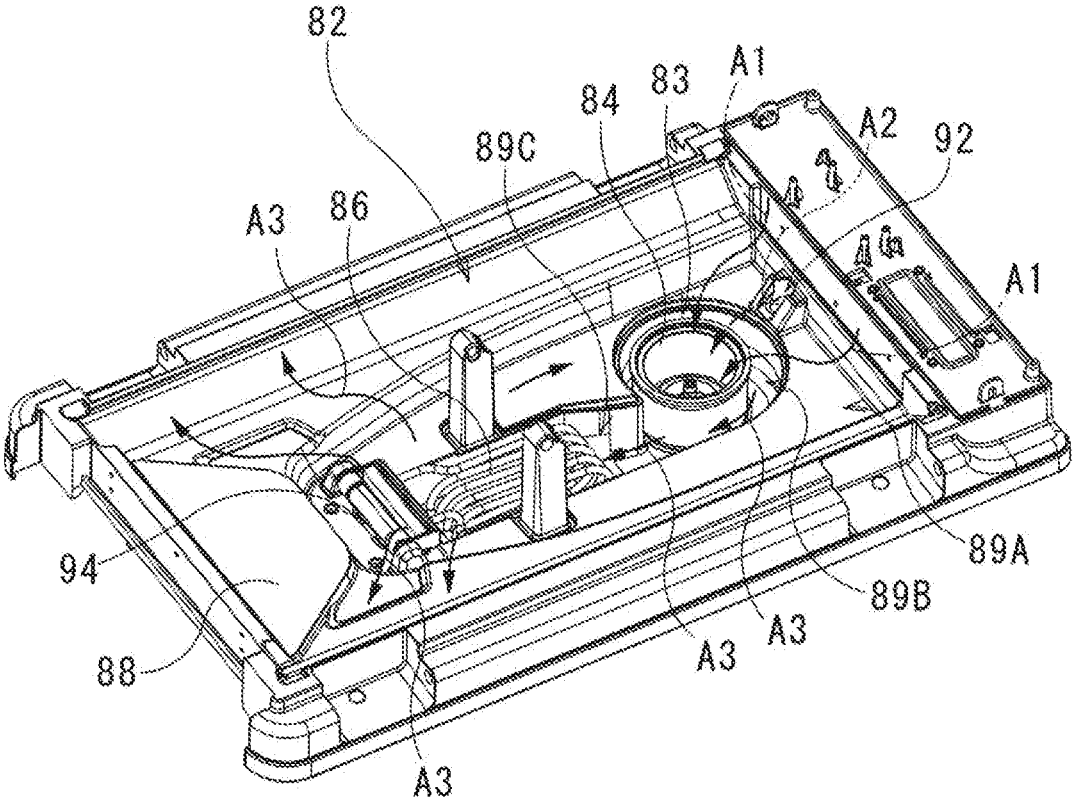
FIG. 12 is a perspective view showing the infant incubator in a state in which the floor plate is detached and an air-conditioning system including a conditioning tub is exposed.

As shown in FIG. 10, the chamber 52 and the air-conditioning system 81 are separated by the floor plate 71. The conditioning tub 82 is formed between the floor plate 71 and a bottom plate 88 of the conditioning tub 82 disposed below the floor plate 71. FIG. 11 shows a state in which the floor plate 71 is exposed by detaching the bed 53 and the enclosure-frame part 72. FIG. 12 shows a state in which the bottom plate 88 of the conditioning tub 82 is exposed by detaching the floor plate 71.

As shown in FIG. 10 and FIG. 11, the air in the chamber 52 can be taken into the conditioning tub 82 (as shown by the dashed line arrows A1) through a rear port 91 (a communication hole between the chamber 52 with the conditioning tub 82) formed at a rear side of the floor plate 71. Here, "the rear" means near to the guide posts 65 and 66. As shown in FIG. 10 and FIG. 12, an intake port 92 of the external air is formed at the rear side of the bottom plate 88 of the conditioning tub 82. The external air can be taken into the conditioning tub 82 through the intake port 92 of the external air as shown by the broken arrow line A2.

A filter (not shown) is disposed in the intake port 92, so that the external air taken through the intake port 92 is purified by the filter. As shown in FIG. 11, the air (the solid line arrows A3) regulated in temperature and humidity in the conditioning tub 82 is supplied into the chamber 52 from the conditioning tub 82 through side ports (communication holes) 93 formed at both sides (the left and right sides) of the floor plate 71.

As shown in FIG. 10 and FIG. 12, on the bottom plate 88 of the conditioning tub 82 disposed below the base table 51, a first recess 89A having a platform shape forming a space with an under surface of the floor plate 71, a second recess 89B further recessed from a bottom surface of the first recess 89A, and a third recess 89C connected to the second recess 89B and formed along a longitudinal direction of the infant incubator 501 (the floor plate 71). The second recess 89B is formed to have a substantially cylindrical shape, so that the fan 84 of the circulator 83 is disposed therein. The third recess 89C is formed to have a substantially rectangle shape, so that the heater 86 is disposed therein.

The above-mentioned intake port 92 of the external air is formed in the vicinity of the second recess 89B of the bottom plate 88 of the conditioning tub 82. In front (at downstream side) of the third recess 89C of the bottom plate 88 of the conditioning tub 82, an intake port 94 of water vapor is formed to penetrate it substantially a vertical direction, so as to be connected to the humidifier 87.

Figure 13:
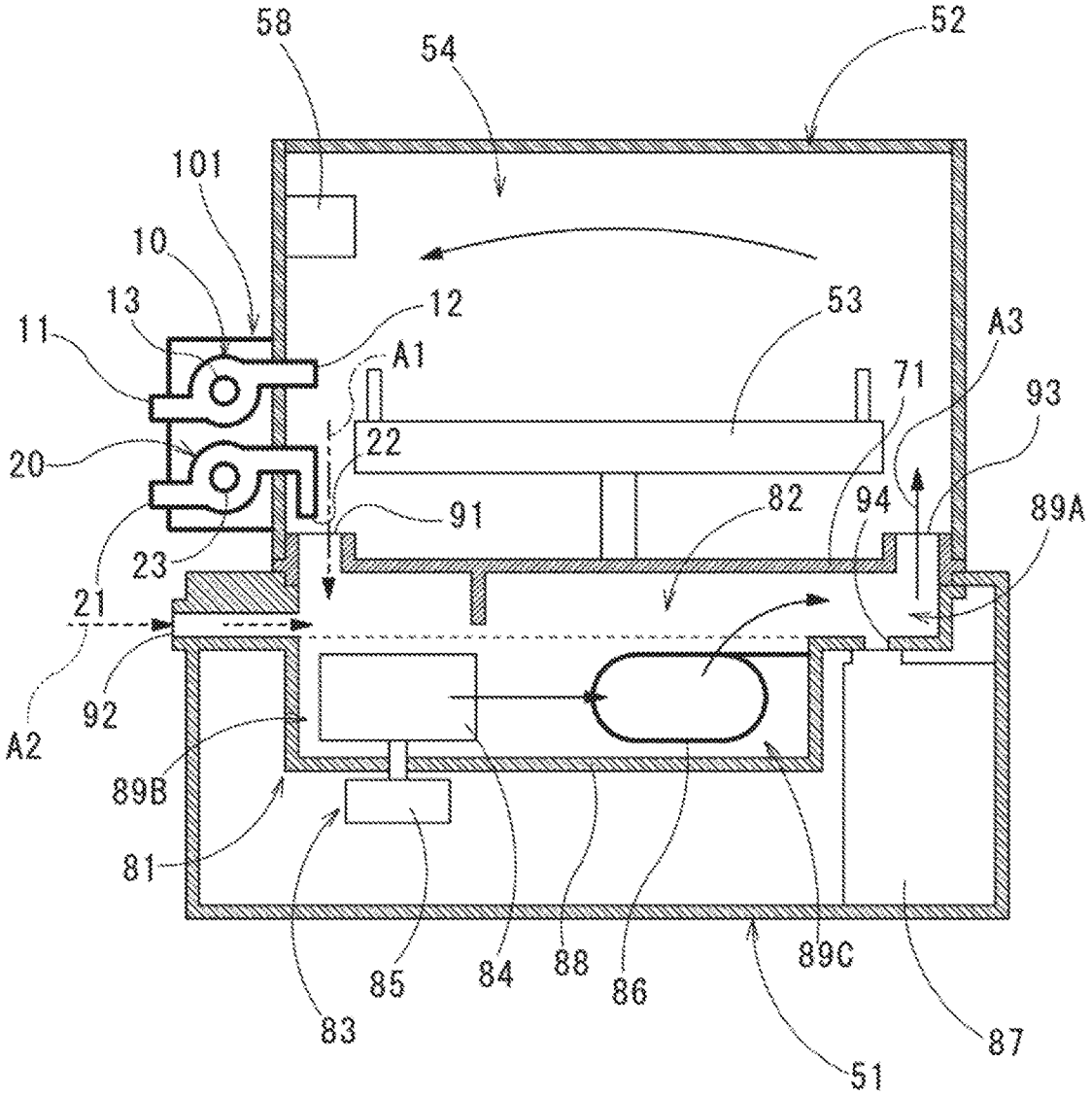
FIG. 13 is a schematic view showing an internal structure of the infant incubator, explaining a stream of air in the chamber and the conditioning tub and a stream of an external air.
Figure 15:
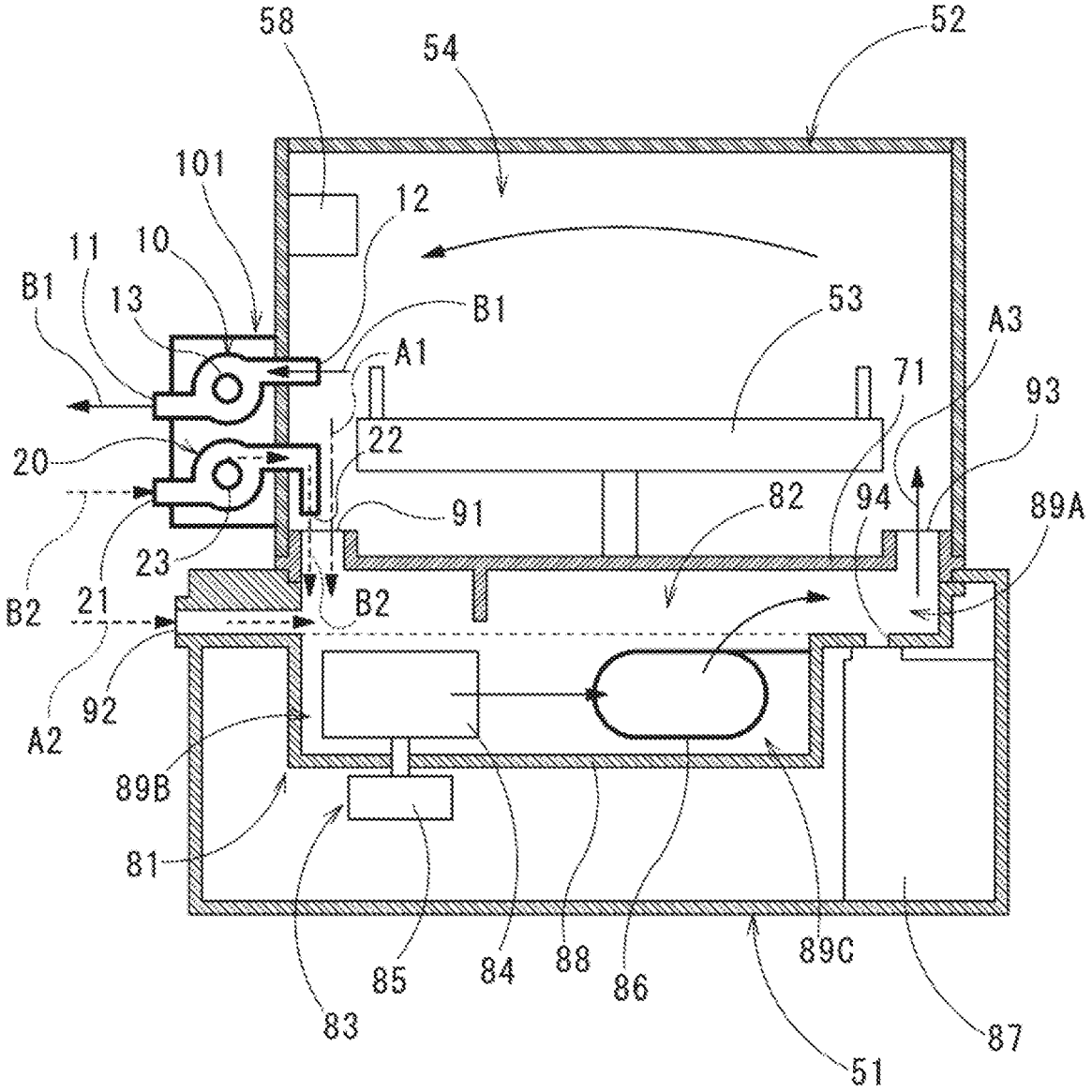
FIG. 15 is a schematic view showing an internal structure of the infant chamber on which the ventilation device is installed, explaining a stream of the air in the chamber and the conditioning tub and a stream of the external air.

FIGS. 13 and 15 shows a schematic view of the infant incubator 501 showing a stream of the air and the external air in the chamber 52 and the conditioning tub 82. In FIGS. 13 and 15, the side ports 93 is schematically shown as if being formed at the front part of the floor plate 71: however, the side ports 93 are formed to be, as shown in FIG. 11, extended along a horizontal direction in FIGS. 13 and 15 to have a slit shape extending at substantially a whole of the first recess 89A.

As shown in FIG. 13, in the conditioning tub 82 formed between the bottom plate 88 thereof and the floor plate 71, the fan 84 disposed in the second recess 89B forms a circulate stream, so that the air is drawn from inside the chamber 52 and introduced into the second recess 89B through the rear port 91 as shown by the dashed line arrow A1, and the external air is also introduced into the second recess 89B through the intake port 92 as shown by the broken line arrow A2: the air from the chamber 52 and the external air are mixed in the second recess 89B.

Then, the mixed air is flown into the third recess 89C and heated by the heater 86 disposed in the third recess 89C, and further humidified by the water vapor supplied from the humidifier 87 through the intake port 94 of the water vapor: subsequently, the air is flown out to the first recess 89A and supplied into the chamber 52 through the side ports 93 opening as the slits longitudinally along the chamber 52 as shown by the solid line arrow A3.

In the infant incubator 501 provided with the air-conditioning system 81, circulating the air in between the chamber 52 and the conditioning tub 82, drawing the external air from the intake port 92, and heating and humidifying the air mixed with the external air, so that the air in the chamber 52 is maintained to the prescribed temperature and humidity. Therefore, the air in the chamber 52 has the higher temperature and humidity than that of the external air; and the chamber 52 inside is positive pressure, i.e., a pressure in the chamber 52 is greater than the outside.

Structure of Ventilation Device for Infant Incubator

Next, the ventilation device 101 for the infant incubator of the present embodiment will be explained. The ventilation device 101 is provided with: an exhaust part 10 connected to the chamber 52 and bringing the air from the chamber 52; an air-supply part 20 connected to the chamber 52 and bringing the external air into the chamber 52; and a housing part 30 coupling the exhaust part 10 and the air-supply part 20 in one unit, as shown in FIG. 1 to FIG. 4.

The housing part 30 of the ventilation device 101 is formed to have substantially a cylindrical shape as shown in FIG. 1 to FIG. 4. The exhaust part 10 and the air-supply part 20 are disposed dividedly at left and right of the housing part 30: between the exhaust part 10 and the air-supply part 20, an operation part 31 provided with a power switch 32; a plug socket part 33 for supplying electric power and the like, a handle part 34 and the like are disposed.

The exhaust part 10 is provided with an exhaust port 11 of the air, an exhaust connect port 12 communicated with inside the chamber 52, and an exhaust blower 13 forming an air stream from the exhaust connect port 12 toward the exhaust port 11. In FIGS. 13 and 15, the exhaust blower 13 and the air-supply blower 23 are schematically illustrated as if being vertically arranged: however, the exhaust blower 13 and the air-supply blower 23 are horizontally arranged.

Figure 2:
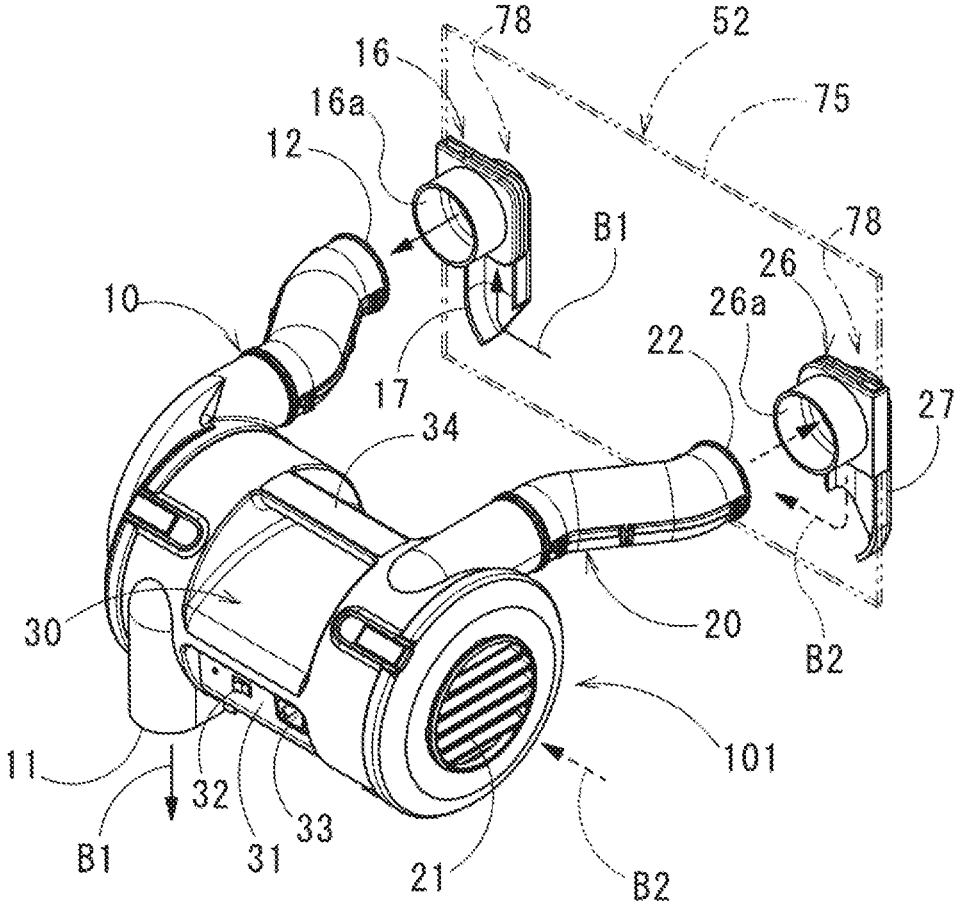
FIG. 2 is a perspective view showing a connection between an exhaust part and an air-supply part of the ventilation device shown in FIG. 1 and a chamber of an infant incubator.
Figure 3:
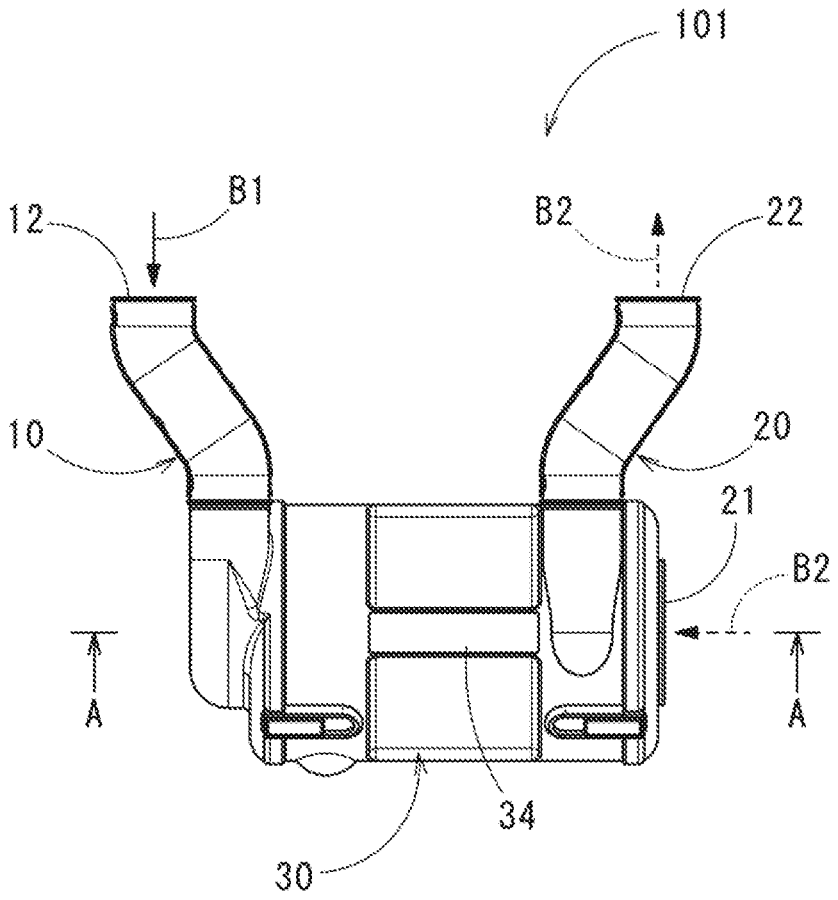
FIG. 3 is a top view of the ventilation device shown in FIG. 1.
Figure 4:
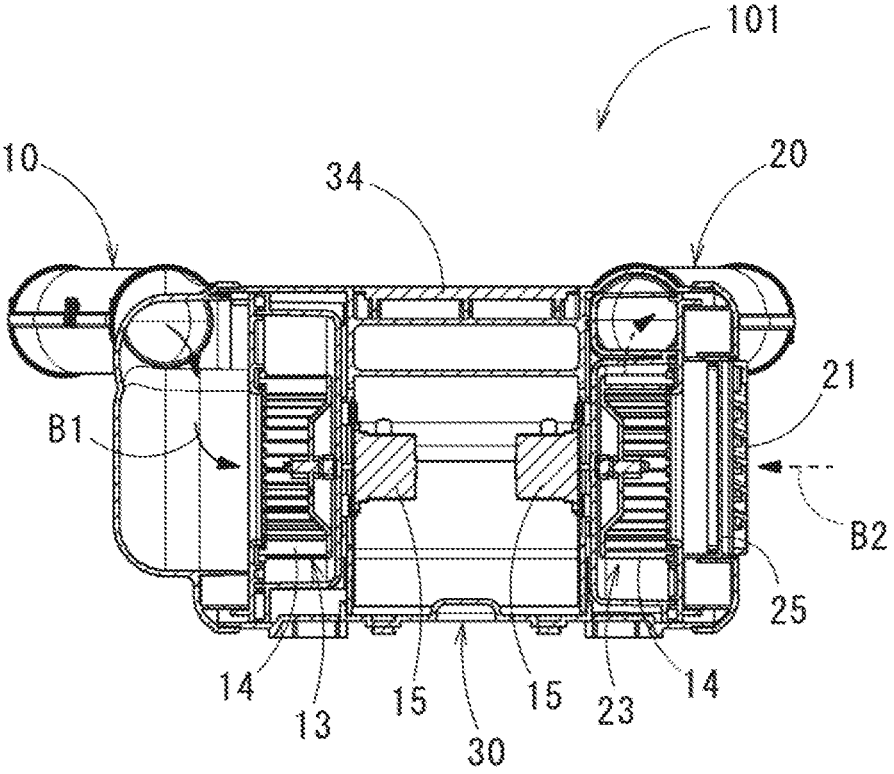
FIG. 4 is a cross-sectional view taken along the line A-A shown in FIG. 3.

As shown in FIG. 2, the exhaust connect port 12 is connected to the rear wall 75 of the enclosure-frame part 72 of the chamber 52. In this case, the exhaust connect port 12 is installed using the through hole 78 disposed at the right-lower part of the rear-wall part 75, and communicating with inside the chamber 52 as shown in FIGS. 6 and 8.

Specifically, replacing the grommet member 55 which is mounted beforehand on the through hole 78 at the right-lower part of the rear-wall part 75 to an exhaust duct member 16 having a vent hole 16*a*, and connecting the exhaust duct member 16 to the exhaust connect port 12 of the exhaust part 10, so that the exhaust connect port 12 is communicated with the chamber 52 through the vent hole 16*a* of the exhaust duct member 16.

The exhaust duct member 16 is provided with an exhaust guide duct 17 guiding the air stream from the rear-wall part 75 of the chamber 52 toward the exhaust connect port 12 of the exhaust part 10, as shown in FIGS. 2 and 8. The exhaust guide duct 17 is formed to be extended downward along an inner surface of the rear-wall part 75 and an end part (a lower end part) thereof is bent toward the rear port 91 (not shown in FIG. 14), as shown in FIGS. 2 and 8.

As described above, the air in the chamber 52 is introduced into the conditioning tub 82 through the rear port 91 and back to the chamber 52 through the side ports 93 to be circulated between the chamber 52 and the conditioning tub 82. Since the lower end part of the exhaust guide duct 17 is disposed toward the rear port 91, the air in the chamber 52 just before being introduced into the conditioning tub 82 from the chamber 52 through the rear port 91 can be actively exhausted outside from the exhaust guide duct 17 through the exhaust connect port 12 and the exhaust port 11.

The exhaust port 11 of the exhaust part 10 is disposed with exposed outside the chamber 52. The exhaust blower 13 is disposed between the exhaust connect port 12 and the exhaust port 11.

The air-supply part 20 is provided with an intake port 21 of the external air, an air-supply connect port 22 communicating with inside the chamber 52, a filter 25 dispose between the intake port 21 and the air-supply connect port 22, and an air-supply blower 23 forming a stream of the external air from the intake port 21 toward the air-supply connect port 22, as shown in FIG. 1 to FIG. 4.

Figure 14:
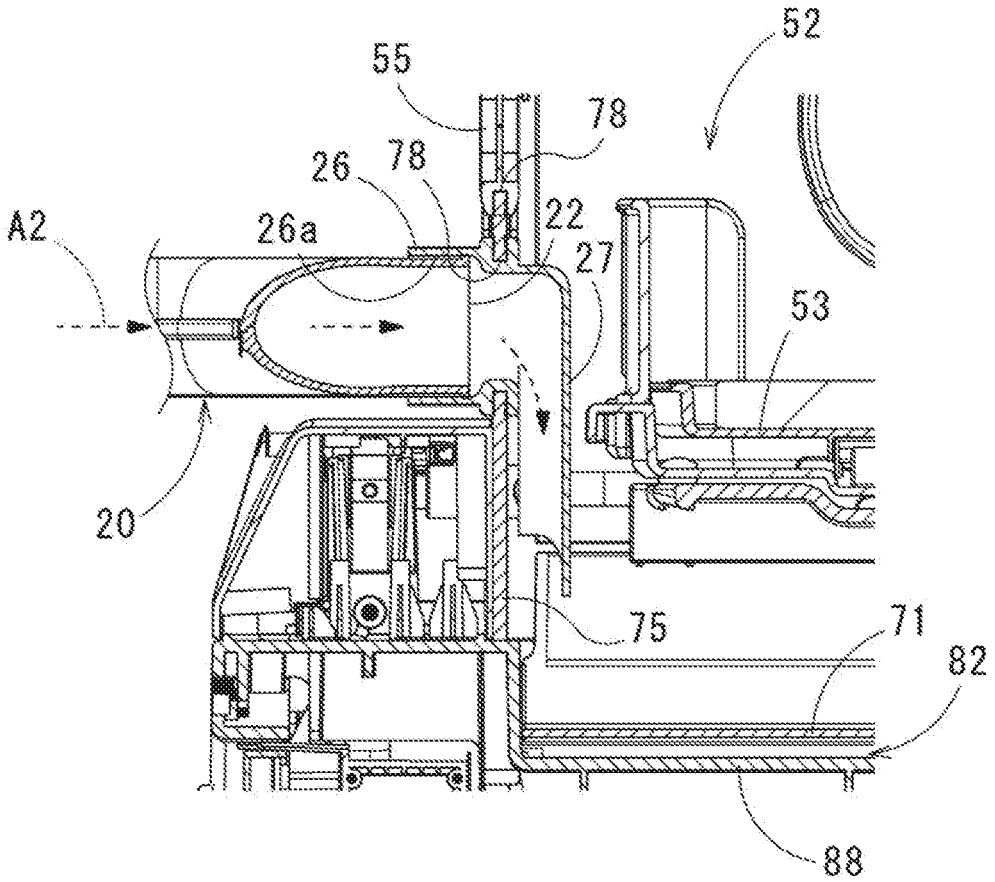
FIG. 14 is a cross sectional view of a principal part of a vicinity of an air-supply duct member of the infant incubator taken along the line C-C shown in FIG. 9.

As shown in FIG. 2, the air-supply connect port 22 is connected to the rear-wall part 75 of the enclosure-frame part 72 of the chamber 52. As shown in FIGS. 2, 8 and 14, the air-supply connect port 22 is mounted using the through hole 78 of the rear-wall part 75 as in the exhaust connect port 12 shown in FIG. 14. The air-supply connect port 22 is connected to the through hole 78 disposed at the left-lower part of the rear-wall part 75 on the opposite side to the through hole 78 on which the exhaust duct member 16 of the exhaust connect port 12 is mounted.

Specifically, exchanging a grommet member 55 mounted beforehand on the left-lower part of the rear-wall part 75 to an air-supply duct member 26 having a vent hole 26*a*; and connecting the air-supply connect port 22 of the air-supply part 20 to the air-supply duct member 26: so that the chamber 52 is communicated with the air-supply connect port 22 through the vent hole 26*a* of the air-supply duct member 26.

A supply guide duct 27 is also provided at the air-supply duct member 26 as shown in FIG. 8 and FIG. 14, so as to guide a stream of the external air from the air-supply connect port 22 of the air-supply part 20 toward the rear port 91 of the floor plate 71. The supply guide duct 27 is formed to be extended downward along the inner surface of the rear-wall part 75 as shown in FIGS. 2, 8 and 14, and an end (a lower end) thereof is bent toward the rear port 91 (not illustrated in FIGS. 2 and 14). The external air supplied into the chamber 52 through the air-supply part 20 is guided to the rear port 91 (a through hole between the chamber 52 and the conditioning tub 82) disposed at the lower part of the chamber 52 by the supply guide duct 27.

As described above, the exhaust guide duct 17 connected to the exhaust connect port 12 is also formed to be extended downward along the inner surface of the rear-wall part 75 as in the supply guide duct 27 connected to the air-supply connect port 22. Specifically, the exhaust guide duct 17 is extended to the lower position than the bed 53. Accordingly, the exhaust part 10 does not exhaust the air in the upper part than the bed 53, but exhausts the air in the lower part than the bed 53.

As a result, the air heated by the heater 86 is exhausted after reaching above the bed 53, so that it is possible to reduce an influence on temperature distribution above the bed 53 by the exhaustion. Although FIGS. 13 and 15 show schematically, the exhaust guide duct 17 at the exhaust side is actually extended from the exhaust connect port 12 to the vicinity of the rear port 91; and the supply guide duct 27 is also extended from the air-supply connect port 22 to the vicinity of the rear port 91.

As described above, the exhaust duct member 16 is disposed at the right side of the rear-wall part 75 (the left side in FIG. 1); and the air-supply duct member 26 is disposed at the left side of the rear-wall part 75 (the right side in FIG. 1): in the chamber 52, the opening of the supply guide duct 27 of the air-supply duct member 26 is apart from the opening of the exhaust guide duct 17 of the exhaust duct member 16. Accordingly, it is possible to prevent the external air supplied into the chamber 52 from the air-supply connect port 22 being exhausted from the exhaust connect port 12.

Therefore, it is possible to smoothly supply the external air from the air-supply part 20 into the chamber 52, and it is possible to smoothly exhaust the air in the chamber 52 through the exhaust part 10.

The intake port 21 of the air-supply part 20 is disposed to be exposed outside the chamber 52. The air-supply blower 23 is disposed at a lower-stream section of the filter 25 disposed between the air-supply connect port 22 and the intake port 21; that is to say, between the filter 25 and the air-supply connect port 22.

Figure 1:
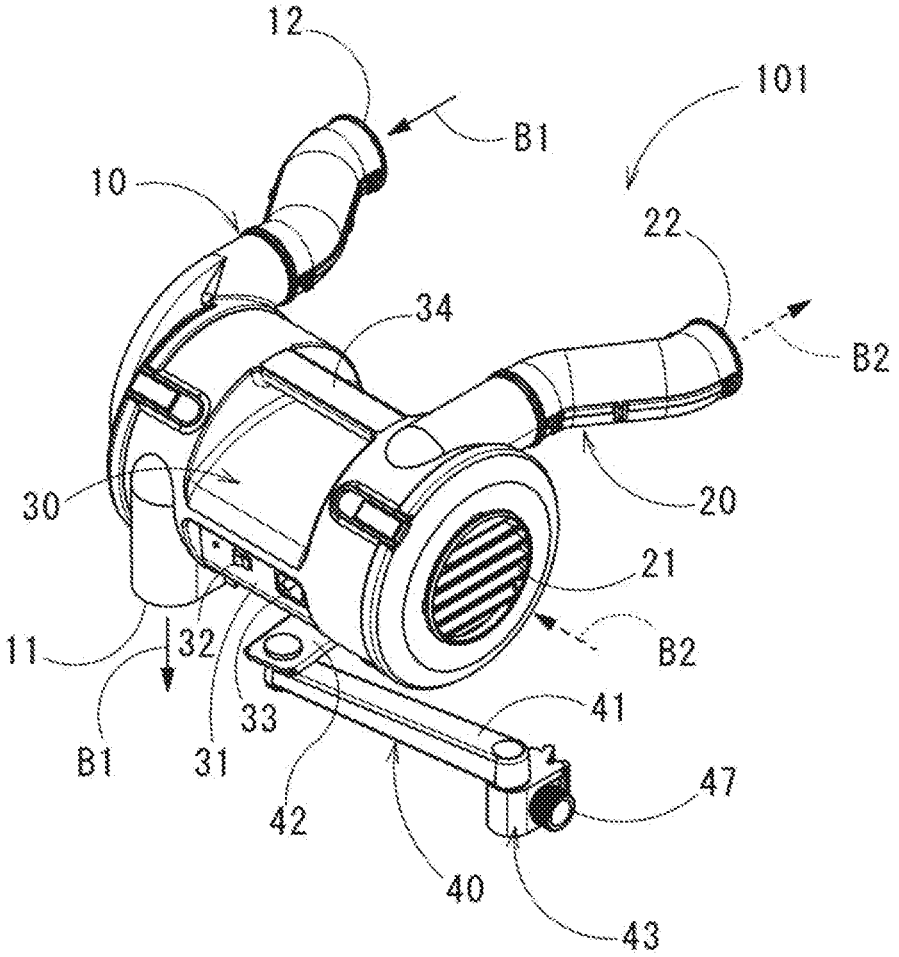
FIG. 1 is an outside perspective view of a ventilation device of an embodiment of the present invention.

As shown in FIG. 1 and FIG. 2, the intake port 21 of the air-supply part 20 opens toward a different direction than the exhaust port 11 of the exhaust part 10 with about 90°. Therefore, it is possible to prevent the air exhausted from the exhaust port 11 from being drawn from the intake port 21. Accordingly, it is possible to supply the external air smoothly from the intake port 21 into the chamber 52.

The filter 25 may be disposed between the intake port 21 and the air-supply blower 23 as in the ventilation device 101 for the infant incubator of the present embodiment; alternatively, it may also be disposed between the air-supply blower 23 and the air-supply connect port 22 at the lower stream section. In either case, the external air flowing in the air-supply part 20 is purified at the filter 25, then supplied into the chamber 52. Accordingly, the chamber 52 can be favorably maintained in a sanitary condition.

As described above, in the ventilation device 101 for the infant chamber of the present embodiment, two blowers 13 and 23, which are the exhaust blower 13 and the air-supply blower 23, are provided.

Each of the blowers 13 and 23 is formed from, for example, a centrifugal blower provided with a fan 14 and a motor 15. Generating air streams by the respective blower 13 and 23, the air stream from the exhaust connect port 12 toward the exhaust port 11 and the air stream from the intake port 21 toward the air-supply connect port 22 are formed, so that the air in the chamber 52 can be changed to the external air and ventilated.

At least one of the exhaust part 10 and the air-supply part 20 is provided with the blower, so that the air in the chamber 52 can be exchanged to the external air and ventilated. As in the ventilation device 101 for the infant incubator according to the present embodiment, both the exhaust part 10 and the air-supply part 20 are provided with the blowers 13 and 23 respectively, it is possible to precisely control the exhaust air-flow rate from the chamber 52 by the exhaust part 10 and the supplying air-flow rate of the external air by the air-supply part 20.

Even when one of the blowers fails, the other works because the blowers 13 and 23 are individually controlled, so that it is possible to exhaust the air and supply the external air.

As shown in FIG. 6, in the ventilation device 101 of the infant incubator of the present embodiment, a fixture 40 is removably mounted on the guide post 66 of the infant incubator 501. The ventilation device 101 is stably mounted on the infant incubator 501 by the fixture 40.

The guide post 66 of the infant incubator 501 is formed from extruded material having substantially a same cross section along a longitudinal direction (a vertical direction) as shown in FIG. 6 and FIG. 7. On a rear side surface of the guide post 66, a guide groove 66*a* is made extending in the longitudinal direction. Fixing the fixture 40 to the guide groove 66*a*, the ventilation device 101 can be installed to the infant incubator 501.

Figure 5:
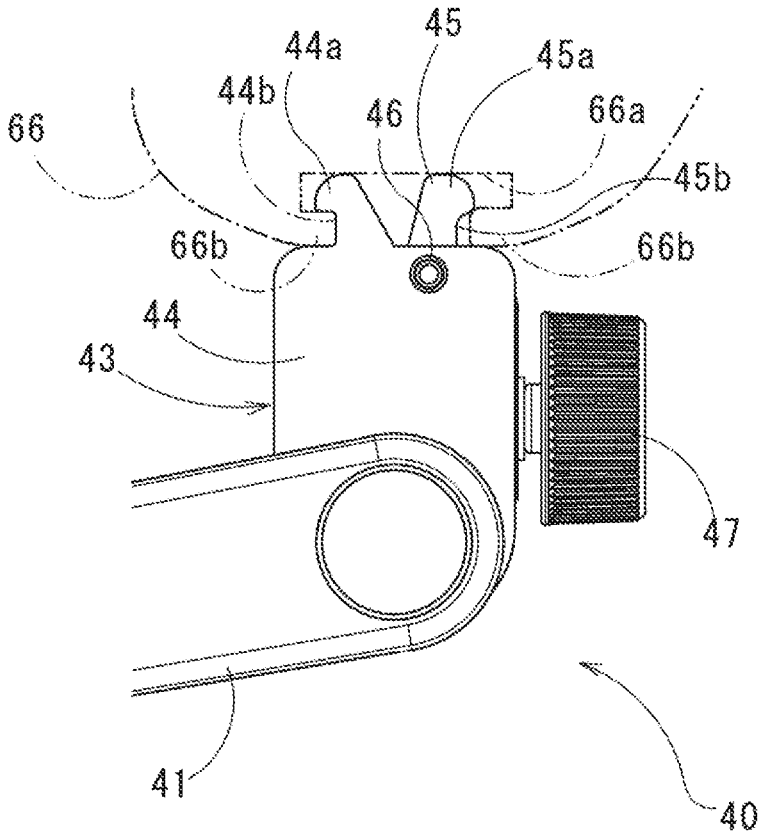
FIG. 5 is an enlarged view of a principal part of a vicinity of a mount part of a fixture.

As shown in FIG. 5, a pair of bars 66*b* and 66*b* are formed along the longitudinal direction of the opening of the guide groove 66*a*, so that the guide groove 66*a* of the guide post 66 has an opening with a width narrower than a width inside. The other side surfaces than the rear surface of the guide post 66 may also have the other guide groove 66*a*. As shown in FIG. 6 and FIG. 7, the guide groove is also formed at a left side surface of the guide post 66 of the infant incubator 501.

The fixture 40 is provided with an arm part 41, a support part 42 formed rotatably at a tip part of the arm part 41, and a mount part 43 formed rotatably at a base part of the arm 41 as shown in FIG. 1. Fixing the ventilation device 101 on the support part 42, the support part 42 and the ventilation device 101 are integrally structured.

The mount part 43 is provided with a fix member 44 having a first hook part 44*a*, a movable member 45 having a second hook part 45*a*, and a shaft part 46 supporting the movable member 45 rotatably on the fix member 44 as shown in FIG. 5. The first hook part 44*a* has a recess part 44*b* and the second hook part 45*a* has a recess part 45*b*. The recess parts 44*b* and 45*b* open to opposite directions.

A knob part 47 is attached to the fix member 44 of the fixture 40 which can be screwed in/out. Advancing or reversing the knob part 47 by screwing, the movable member 45 is rotated around the shaft part 46 in a clockwise direction or a counter-clockwise direction in FIG. 5.

By screwing back the knob part 47 in a state shown in FIG. 5, a space between the first hook part 44*a* and the second hook part 45*a* is narrowed, so that the first hook part 44*a* and the second hook part 45*a* are inserted to an inside space with a large width through the narrow-width opening part of the guide groove 66*a* of the guide post 66*a*. Then, by screwing the knob part 47 in this inserted state, the space between the first hook part 44*a* and the second hook part 45*a* are broaden, the recess part 44*b* of the first hook part 44*a* and the recess part 45*b* of the second hook part 45*a* are pressed on the pair of bars 66*b* of the guide groove 66*a*, so as to mesh together. As a result, the fixture 40 is fixed to the guide post 66 and the ventilation device 101 can be installed stably on the infant incubator 501.

In order to remove the fixture 40 from the guide post 66, screwing the knob part 47 back so that the space between the first hook part 44*a* and the second hook part 45*a* is reduced, the recess parts 44*b* and 45*b* of the first hook part 44*a* and the second hook part 45*a* are easily removed from the pair of bars 66*b* and 66*b* of the guide groove 66*a*.

The fixture 40 is not limited to the above described structure, and the ventilation device 101 may be installed on the infant incubator 501 by the other structures.

Function of Ventilation Device for Infant Incubator

Next, function of the ventilation device 101 installed on the infant incubator 501 will be explained.

As shown in FIG. 6, in the infant incubator 501 on which the ventilation device 101 is installed, the environment in the infant chamber 52 is controlled only by the air-conditioning system 81 of the infant incubator 501 when the ventilation device 101 is stopped.

As shown in FIG. 13, by the air-conditioning system 81 the air is circulated between the chamber 52 and the conditioning tub 82, the external air is introduced via the intake port 92, and the introduced air is heated and humidified, so that the air in the chamber 52 is maintained to preset temperature and humidity.

For such control of the infant incubator 501, in order to reduce the temperature and the humidity in the chamber 52, it may be performed to stop the heater 86 and the humidifier 87 of the air-conditioning system 81 or to increase an amount of the air movement (an air-flow rate) by the circulator 83 (the fan 84), by increasing fan speed in the conditioning tub 82. However, the heater 86 and the like in the heated state cannot stop heating and humidifying immediately.

The air in the chamber 52 has the temperature higher than the outside (the external air) and the chamber 52 inside is the positive pressure (i.e., a pressure in the chamber 52 is greater than the outside). Accordingly, even though the air-flow rate is increased, most of the air is circulated as it is between the chamber 52 and the conditioning tub 82, so that it is not easy to introduce fresh external air via the intake port 92 into the conditioning tub 82. Therefore, it takes a long time to reduce the temperature and the humidity in the chamber 52.

Under such a condition, operating the ventilation device 101, the temperature and the humidity in the chamber 52 can be immediately reduced, so that the environment in the chamber 52 can be smoothly controlled by the air-conditioning system 81 and the ventilation device 101.

FIG. 15 shows a schematic view of the infant incubator 501 in which a stream of the air and the external air in the chamber 52 and the conditioning tub 82 when the ventilation device 101 is in operation is illustrated.

Starting the operation of ventilation device 101 by switching on the power switch 32, as shown in FIG. 15, an air stream is generated by the respective blowers 13 and 23 disposed in the exhaust part 10 and the air-supply part 20. That is to say, in the exhaust part 10, the air stream (shown by the solid line arrow B1) is generated from the exhaust connect port 12 toward the exhaust port 11 by the exhaust blower 13 at the exhaust side.

In the air-supply part 20, the external-air stream (shown by the broken line arrow B2) is generated from the intake port 21 toward the air-supply connect port 22 by the air-supply blower 23 at the air-supply side. As a result, the air is actively taken out from the chamber 52 via the exhaust part 10; or the external air is actively introduced into the chamber 52 via the air-supply part 20.

Accordingly, the heated and humidified air in the chamber 52 can be exchanged to the external air having the lower temperature and humidity than that of the air in the chamber 52; so that the temperature and the humidity of the air circulated between the chamber 52 and the conditioning tub 82 can be forcibly reduced.

As shown in FIG. 2 and FIG. 8, in the ventilation device 101, the supply guide duct 27 is provided to guide the external air supplied from the air-supply part 20 toward the rear port 91 which is a connection port between the chamber 52 and the conditioning tub 82. The external air which is introduced anew from the air-supply part 20 is guided by the supply guide duct 27 toward the rear port 91.

Furthermore, the external-air stream guided by the supply guide duct 27 does not go against the air stream (the dashed line arrow A1) circulating between the chamber 52 and the conditioning tub 82, and is supplied along this air stream. Accordingly, the external air newly introduced through the air-supply part 20 can be carried on the air stream circulated between the chamber 52 and the conditioning tub 82 of the air-conditioning system 81.

As a result, the circulated air and the new external air are mixed in the conditioning tub 82, so that the conditioned air (the solid line arrow A3) in the temperature and the humidity in the conditioning tub 82 can be supplied into the chamber 52. Accordingly, the environment in the chamber 52 can be uniform without a partial temperature unevenness, and the temperature and the humidity in the chamber 52 can be evenly controlled.

The operation of the ventilation device 101 can be stopped by turning off the power switch 32 of the ventilation device 101.

In the ventilation device 101, the exhaust part 10 and the air-supply part 20 are provided with the blowers 13 and 23 respectively, so that it is possible to accurately control the exhaust air-flow rate from the chamber 52 by the exhaust part 10 and the supplying air-flow rate of the external air by the air-supply part 20 by the blowers 13 and 23 respectively. As a result, the temperature and the humidity in the chamber can be exactly controlled.

As described above, the temperature and the humidity in the chamber 52 can be actively reduced by using the ventilation device 101 of the present embodiment; using the air-conditioning system 81 which can heat and humidify the air and the ventilation device 101 in combination, the temperature and the humidity in the chamber 52 can be smoothly controlled.

Accordingly, even when using respiratory supporting devices for the CPAP method and the high flow therapy and the like, and even when the chamber 52 is covered, the temperature and the humidity in the chamber 52 can be suitably maintained.

The present invention is not limited to the above-described embodiments and various modifications may be made without departing from the scope of the present invention.

For example, in the ventilation device 101 for the infant incubator of the above-mentioned embodiment, the exhaust part 10 and the air-supply part 20 are formed to have relatively long channels; the exhaust port 11 and the exhaust connect port 12 are disposed at a distance in the exhaust part 10; and the intake port 21 and the air-supply connect port 22 are disposed at a distance in the air-supply part 20 though, the present invention is not limited to this structure.

The channels can be short: for example, the exhaust part 10 and the air-supply part 20 may be formed in about a thickness of the fan 14. It is also applicable to install the fan 14 on the through holes 78, the access ports 56 and the like for ventilation of the chamber 52.

On the contrary, it is also applicable to lengthen the channels longer than that in the exhaust part 10 and the air-supply part 20 of the ventilation device 101 of the present embodiment. Shapes of the channels are not limited to the present embodiment, but can be freely selected appropriately.

Although the ventilation device 101 is detachably attached on the guide post 66 of the infant incubator 501 in the present embodiment, it is not always necessary to provide the ventilation device for the infant incubator detachably. The present invention includes a structure in which the ventilation device is fixed on the infant incubator and disabled to be detached.

Although the exhaust connect port 12 and the air-supply connect port 22 of the ventilation device 101 are connected to the chamber 52 using the through holes 78 at the rear-wall part 75, it is applicable to connect the exhaust connect port 12 and the air-supply connect port 22 to the other parts forming the chamber 52 such as the top-hood part 73, the treatment doors 76 and 77, and the like.

What is claimed is:

1. An infant incubator comprising:

a chamber for an infant, having a floor plate and an enclosure frame part, wherein the frame part has through holes which communicate inside and outside the chamber;

a conditioning tub separated from the chamber by the floor plate, wherein the floor plate has communication holes for communicating the conditioning tub with the chamber;

a circulator provided in the conditioning tub for generating an air-stream circulating between the chamber and the conditioning tub through the communication holes;

a heater provided in the conditioning tub for heating air in the conditioning tub; and a ventilation device detachably installed on the chamber, wherein the ventilation device is provided with:

an exhaust connect port connected to one of the through holes of the chamber;

an exhaust port communicated with the exhaust connect port;

an air-supply connect port connected to another of the through holes of the chamber;

an intake port of external air communicated with the air-supply connect port;

an air-supply blower installed between the intake port and the air-supply connect port and generates an external-air stream flowing from the intake port of the external air toward the air-supply connect port; and an exhaust blower installed between the exhaust connect port and the exhaust port and generates an air stream flowing from the exhaust connect port toward the exhaust port, wherein the circulated air is exhausted from the chamber through the exhaust connect port and the exhaust port, the external air which is newly introduced from the air-supply connect port is supplied toward one of the communication holes and is introduced in the conditioning tub, the circulated air and the external air are mixed in the conditioning tub, and heated by the heater, and second intake port of the external air is formed at the conditioning tub.

2. The infant incubator according to claim 1, further comprising:

a supply guide duct communicating with the air-supply connect port and disposed in the chamber, extending from the through hole to which the air-supply connect port is connected toward the one of the communication holes.

3. The infant incubator according to claim 1, wherein a supplying air-flow rate of the air-supply blower is larger than an exhaust air-flow rate of the exhaust blower.

4. The infant incubator according to claim 1, further comprising a humidifier supplying water vapor to the circulated air in the conditioning tub; and an intake port of water vapor being connected to the humidifier, wherein the water vapor is supplied to the conditioning tub through the intake port of water vapor.

* * * * *